US010201725B2

(12) United States Patent
Shiozaki

(10) Patent No.: US 10,201,725 B2
(45) Date of Patent: Feb. 12, 2019

(54) SPORTS SWINGING EXERCISE RESISTANCE DEVICE

(71) Applicant: Steven J. Shiozaki, Belmont, CA (US)

(72) Inventor: Steven J. Shiozaki, Belmont, CA (US)

( * ) Notice: Subject to any disclaimer, the term of this patent is extended or adjusted under 35 U.S.C. 154(b) by 0 days.

(21) Appl. No.: 14/194,453

(22) Filed: Feb. 28, 2014

(65) Prior Publication Data

US 2014/0243170 A1 Aug. 28, 2014

Related U.S. Application Data

(60) Provisional application No. 61/770,329, filed on Feb. 28, 2013.

(51) Int. Cl.
*A63B 21/008* (2006.01)
*A63B 69/00* (2006.01)

(52) U.S. Cl.
CPC ..... *A63B 21/0088* (2013.01); *A63B 69/0002* (2013.01); *A63B 2069/0008* (2013.01)

(58) Field of Classification Search
CPC ..... A63B 21/0088; A63B 69/3632; A63B 69/3638; A63B 2069/0088; A63B 2225/01
See application file for complete search history.

(56) References Cited

U.S. PATENT DOCUMENTS

| | | | | |
|---|---|---|---|---|
| 3,809,397 | A | 5/1974 | Gruenewald | |
| 5,207,625 | A | 5/1993 | White | |
| 5,335,918 | A * | 8/1994 | Rupnik et al. | 473/228 |
| 5,472,394 | A * | 12/1995 | Michaelson | 482/74 |
| 5,571,048 | A * | 11/1996 | Kenney | 473/228 |
| 5,803,838 | A | 9/1998 | DeMarini | |
| 5,888,154 | A * | 3/1999 | Hartman | 473/457 |
| 2004/0063519 | A1 * | 4/2004 | Liberatore | 473/457 |
| 2006/0287122 | A1 * | 12/2006 | Ray | 473/228 |
| 2012/0015783 | A1 * | 1/2012 | Brown | A63B 21/0004 482/74 |
| 2012/0289382 | A1 * | 11/2012 | Haddad et al. | 482/93 |

* cited by examiner

*Primary Examiner* — Jennifer M Deichl
(74) *Attorney, Agent, or Firm* — Michael L. Greenberg, Esq.; Greenberg & Lieberman, LLC

(57) ABSTRACT

A sport swinging resistance exercise device is described that is designed for providing air resistance when swinging elongated sports equipment. An athlete can change the amount of air resistance by either using a different air resistance vane, or a resistance vane with variable opening features. An alignment marker for a right-handed athlete and second alignment marker one for a left-handed athlete is used to orient the sports swinging exercise device to operate optimally. The sports swinging exercise device is made mainly from durable, light-weight materials such as rip-stop nylon, for lightness and air blocking capabilities. When not in use the sports swinging exercise device and other optional air resistance devices can be stored in a small storage bag to keep them together and for easy transportation and accessibility in an equipment bag such as a batting bag.

1 Claim, 17 Drawing Sheets

SECTION B-B

SECTION A-A

DETAIL C

SECTION D-D

SECTION E-E

SECTION F-F

SECTION G-G

SECTION H-H

SPORTS SWINGING EXERCISE RESISTANCE DEVICE

CONTINUITY

This application is a non-provisional application of provisional patent application No. 61/770,329 filed on Feb. 28, 2013, and priority is claimed thereto.

FIELD OF THE PRESENT INVENTION

The present invention relates to a training aid, and more specifically a training aid for elongated sport equipment such as a baseball bat, fast pitch softball bat, softball bat, lacrosse stick, or golf club which a full motion swing pertaining to that sport can be executed against air resistance to improve the swing quickness and strength of that stated motion.

BACKGROUND OF THE PRESENT INVENTION

It is known that there are different sizes of elongated sports equipment as well as different sizes and skill levels of athletes. It is very desirable to have a quick and strong swinging motion when using elongated sports equipment that is used to strike or hit another piece of sports equipment related to that stated sport further and harder. For sports where elongated sports swinging equipment such as a ball is in motion, quickness is important to swing the elongated sports equipment to the desired position and location to strike, throw or hit the moving sports equipment, such as a bat hitting a ball. These types of swings are very a complex athletic motion and movement with very specific techniques needed to execute the motion correctly. The said baseball or fast pitch softball comes towards the player at a rapid speed forcing the player to react quickly to hit the ball. An athlete possessing a quick swing allows the athlete to respond as quickly as possible to the pitched ball, thus making him or her a better player.

Prior art U.S. Pat. No. 5,888,154, issued on Mar. 30, 199 to Harman is for a Resistance device for a baseball bat, which teaches an apparatus that can be made from nylon. Nylon is slippery on smooth surfaces that are found on elongated sports swinging equipment such as baseball bats regardless of material the bat is made from. To prevent the said invention from slipping off the elongated sports swinging equipment, plurality of non-slip material is added inside of the sleeve. One location for the non-slip material is directly behind the cord channel of the sleeve. The non-slip material of the present invention is held behind the cord channel with pressure from the tighten cord, and inside of the sleeve, with pressure from the tighten straps helps to prevent the present invention from slipping off the elongated sports equipment during a full swing.

Some methods to increase quickness and strength in a swing do not involve the actual piece of sport equipment or engage the full swing motion of the sports swing. Athlete can weight train, do resistance exercises with elastic bands or tubing or other resistance training equipment but as stated above does not involved the full sport swinging motion. Using the sports swinging exercise equipment, the athlete can use their own elongated sports swinging equipment in a place that has space enough to execute the full sport swing like a designated area such as a batting cage, or a sports field, or even a back yard.

Others methods to increase quickness and strength that do use a full swing motion technique use a heavier piece of sport equipment has its own drawbacks, such as the Easton Bat Weight 16 oz, Power Warp Bat Weight 16/24 oz, Sklz 12 oz bat weight, the DeMarini 16/20 oz and Akadema weighted barbell training bat. Heavier sports equipment will feel different and may cause the athlete to execute the swinging motion slightly differently to compensate for the new weight, thus not practicing athlete's normal swinging motion. The athlete feeling the extra weight with the heavier sports equipment may develop a different starting motion to overcome the inertia of the heavier sport equipment.

U.S. Pat. No. 5,888,154 to Hartman shows a resistance device for a baseball bat that creates resistance when swinging the baseball bat. This resistance device has a sleeve sized for a baseball bat that lacks an indicator or alignment marker to guide the user to orient the resistance device so the planar flexible rectangular sheet is position to fully engage it. The planar and flexible rectangular sheet is opened-ended, limiting the amount of air it can capture.

One method used to increase air resistance during the swing of swinging sport equipment is demonstrated in U.S. Pat. No. 5,803,838 to DeMarini, where a drogue chute is reefed with suspension lines and reef tape with air permeable netting attached between these suspension lines. The drogue chute breaks away, un-reeling the chute once the bat reaches sufficient speed. However, the DeMarini device must be re-assembled and/or re-attached to the nylon neck after each swing to simulate impact, causing the athlete to stop his training after each time and take the time to reset the air resistance device. The sports swinging exercise device can be used continuously, without stopping to reset or reassemble like when using the DeMarini device.

The DeMarini device has a sleeve that slips over a bat. However it does not have an alignment marker to guide the user in positioning the air resistance device properly. Celone and Yablonowski in U.S. Pat. No. 8,202,294B2 show a swing exercise device for elongated sports equipment where air is captured by a resistance surface, made of nylon membrane, a stiff or rigid light weight sheet or plastic sheet. The resistance surface is limited in the amount of air it can capture. Because it is a flat sheet, Celone and Yablonowski device only provides a set amount of resistance. The coupling links appear to be complex to manufacture with multiple parts, whereas sports swinging exercise device has a sleeve with an open end that is easier to manufacture. Different sized coupling links would be required to secure Celone and Yablonowski device to different type bats. For example, baseball and softball bats have different diameters as specified by different governing associations as well as the larger diameter barrel or smaller neck areas of a bat. Like the Hartman device, the Celone and Yablonowski device does not allow the athlete to change the resistance surface for different air resistance. The device called Powerchute is patent, http://powerchutesports.com/, has similar characteristics but is designed for to work on a golf driver or long wood.

U.S. Pat. No. 5,207,625 to White has plurality of collapsible vanes members on a shaft, the vanes provide air resistance. White claims the said invention assumes a compact shape and facilitates transportation as well as the shaft maybe of length of a golf club or bat which is long and made from plastic, metal or wood suitable materials so the said invention can be long and not collapsed into a very small compact shape.

One method to provide air resistance have a detachable airfoil which provides resistance is showed in U.S. Pat. No.

5,335,918 to Rupnik and Kite. The said airfoil can be fabricated from various materials like wood, plastic, metals or composite materials are all hard and may not be compressed into a small shape to facilitate transportation and ease of storage.

U.S. Pat. No. 3,809,397 to Gruenewald has plurality of vanes fabricated from glass fiber reinforced plastic, the preferred material, is secured by a plurality of screws and bolts to a tubular tapered body thus the invention is not compact or lightweight, and may not facilitate easy transportation. The Power Swing Fan, http://thegolfcoastonline.com/item.asp?PID=774 has similar characteristics. The invention has half the fastening features to assemble the air resistance devices onto the sleeve compared to prior art U.S. Pat. No. 5,888,154 to Hartman.

The SwingWing is patented, http://golfmarketingservices.blogspot.com/2012/08/swingwing-golfpartners-with-ladies.html, has plurality of short vanes for air resistance does not provide the option to change the amount of air resistance. The device has to be filled with air before being used. Left in the blown up state the device will not compress into a small shape without letting the air out.

In conclusion, no sports swinging exercise device formerly developed provides adjustability in air resistance by having the ability to attach different air resistance devices that are made from light-weight, durable materials that said device can be easily stored and transported in a small.

SUMMARY OF THE PRESENT INVENTION

An improved sports swinging exercise device for elongated sports equipment has a vane to direct air into an air resistance device with volume made from lightweight materials. The air resistance device of the present invention preferably is equipped with a plurality of straps to attach to a sleeve with a plurality of attachment features. The present invention provides the athlete with the option to select different degrees of air resistance when using the sport swinging exercise device on elongated swinging sport equipment.

Accordingly several advantages are provided to an improved air resistance device which can be used on the athlete's own elongated swinging sports equipment, has plurality of non-slip material portions on the inside of the said sleeve to prevent the said device from slipping off the elongated swinging sport equipment during use, alignment markers to guide the athlete in orienting the said device for optimal performance, the ability to use said device multiple times in a training sections without stopping to reset or re-assemble, features a sleeve with a plurality of eyelets where different air resistance devices can be used to change the air resistance during the use of the said invention, does not add substantial weight to the elongated swinging sports equipment, and its light weight facilitates easy transportation, and its lightweight material it is constructed out of can be compacted for ease of storage. Still further advantages will become apparent from a study of the following descriptions and accompanying drawings.

DETAILED DESCRIPTION OF THE PREFERRED EMBODIMENT

Figure 1:
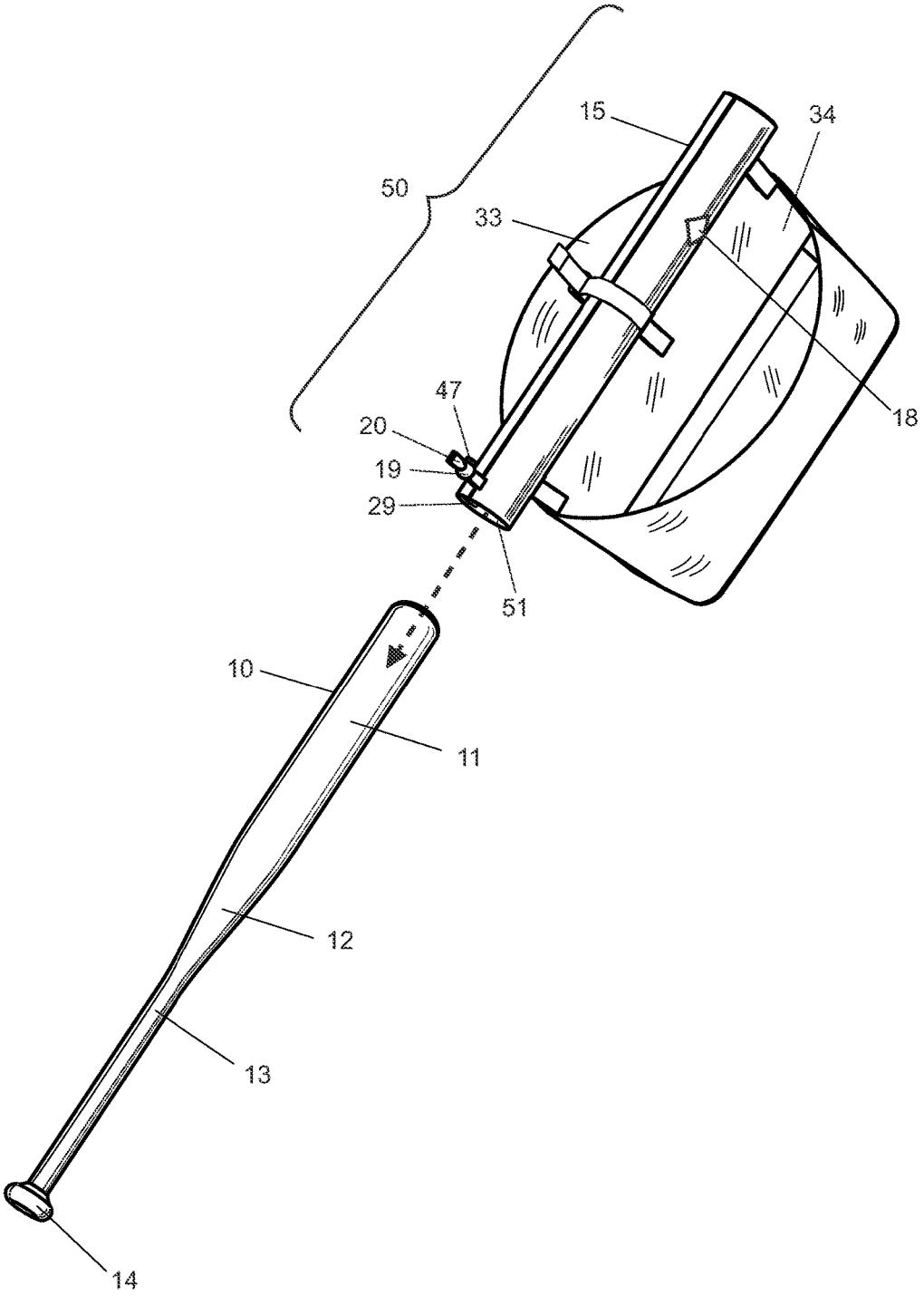
FIG. 1 is a perspective right side view of the sports swinging exercise device before placement of invention on elongated sports equipment such as a bat.

The sports swinging exercise device 50 has features allowing the athlete to change the air resistance device to decrease or increase air resistance. During one training session, if the desire is to work mainly on quickness, the athlete can select to use an air resistance device 43 that suits this training session goal.

Another athlete may wish to work on strength, and would therefore employ an embodiment of the present invention that is equipped with an air resistance device 33 which provides more resistance. Other air resistance devices 41 and 42 are equipped with adjustable openings that permit some air to flow out of the present invention to change the air resistance and not provide just one amount of air resistance. The sports swinging exercise device 50 has flexibility to provide different amounts of resistance training. To secure the sports swinging exercise device 50 to the elongated sports equipment, slip the sleeve 15 over it. The cord lock spring loaded button 47, located at the open end of the sleeve 15, is pushed down to release the cord lock 19 from the cord 20 so it can be moved down the cord 20 towards the bat neck 12 narrowing down the open end of the said sleeve 15 against the elongated sports equipment. Once the cord lock 19 cannot move any closer towards the bat, the cord lock spring loaded button 47 is release to pinch down on the cord 20 to hold the cord lock 19 into position. Other methods to secure the cord lock into place can be a knot, spring loaded mechanism, or friction. The cord 20 can be made of man-made or natural materials. The cord 20 can also be rope, string, and ribbon like material and construction. The cord lock 19 helps to prevent the open end of the sleeve from expanding and the sports swinging exercise device 50 from slipping off the bat along with the plurality of non-slip material 27, 28, 29, 30, 31 and 32 inside of the sleeve.

The air resistance devices 33, 41, 42, and 43 come in several different sizes, shapes and materials. One air resistance device 43 has an elliptical shape opening tapering down into a rectangular shape when it is inflated with air. Another air resistance device 33 has a circular opening tapering down into a rectangular shape when it is inflated with air. Other air resistances devices 41, 42 have variable openings on the sides and/or bottom to regulate the amount of air resistance by letting some air pass through the openings or staying closed for maximum air resistance. The part of the air resistance device that captures air can be made from a single sheet of material or more. Each air resistance device has a vane 34. The vane 34 at the start of the swinging motion directs air into the air resistance device. As the swing progresses and picks up swing speed, air resistance increases as air fully inflates the vane 34 of the present invention. The vane 34 is trapezoid shape or other shapes and can be made from a single sheet of material or more. The plurality hook pads 35, 36 and 37, and plurality strips of loop 38, 39 and 40 are used to attach the air resistance device to the sleeve 15. Other methods such as mechanical fasteners, clips, and clasps can also be used.

The sports swinging exercise device 50 of the preferred embodiment of the present invention is preferably be made of rip-stop nylon but other materials are suitable. Said device would be sewn together but other methods are suitable. Other parts maybe pre-manufactured, such as hook and loop fasteners, cord, and d-ring loops.

During operation of the preferred embodiment of the present invention, an athlete uses the sports swinging exercise device 50 on conventional elongated sport equipment employed during a normal swing motion to generate air resistance during the swing. Increasing air resistance helps improve quickness and strength of the athlete.

Figure 6:
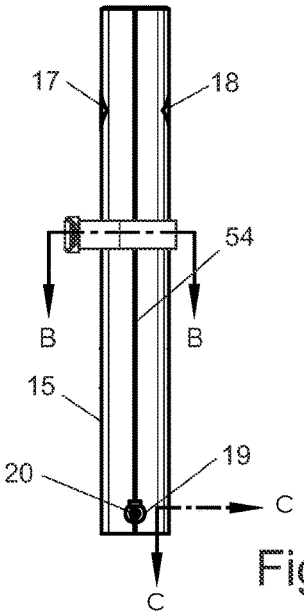
FIG. 6 is a front view of FIG. 5 of the sleeve 15.
Figure 19:
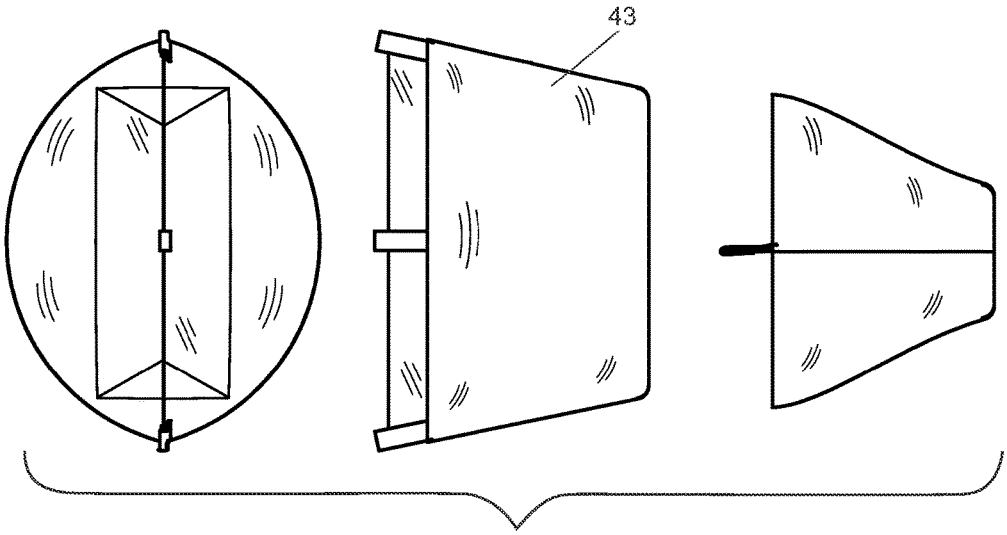
FIG. 19 is orthographic views showing, front, right side, and top, of small air resistance 43.
Figure 20:
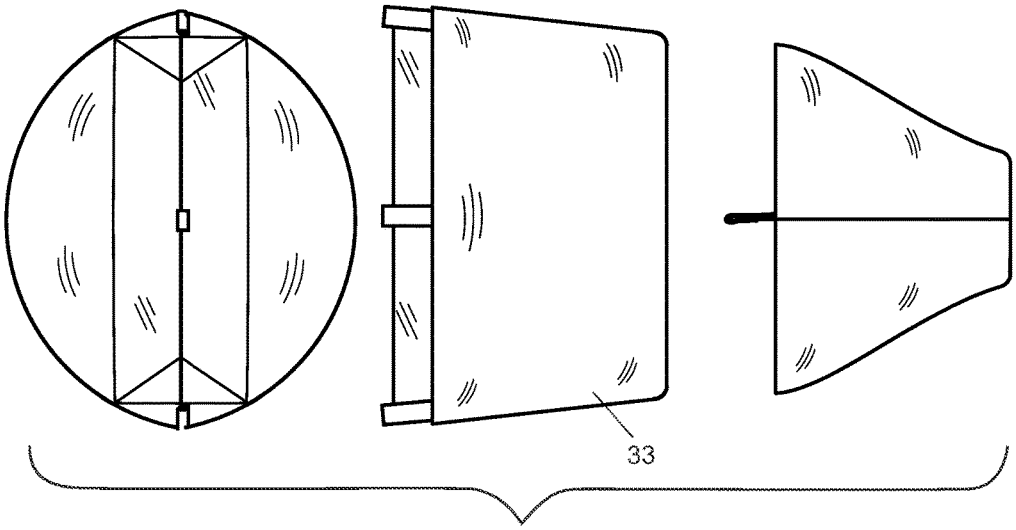
FIG. 20 is orthographic views showing, front, right side, and top, of medium air resistance 33.

The athlete can change the degree of air resistance by exchanging the current air resistance devices 33, 41, 42 and 43 for another one or changing the opening(s) of the air resistance devices, as each resistance device 33, 41, 42, and 43 are sized differently in order to provide varying degrees of air resistance. The sports swinging exercise device 50 is used for training and not for contact against a sports object like a baseball or softball. The sports swinging exercise device 50 can be used multiple times during a training session in the following preferred method:

(1) Select the air resistance device 33/41/42/43 (as seen in FIG. 19 and FIG. 20). Attach selected air resistance device 33/41/42/43 to a Sleeve 15 (FIG. 6).

(2) Slide the open end of the sleeve over a bat barrel 11 (as shown in FIG. 1, FIG. 2, FIG. 3 and FIG. 4) until a sleeve top 16 is against the end of the bat barrel 11.

Figure 4:
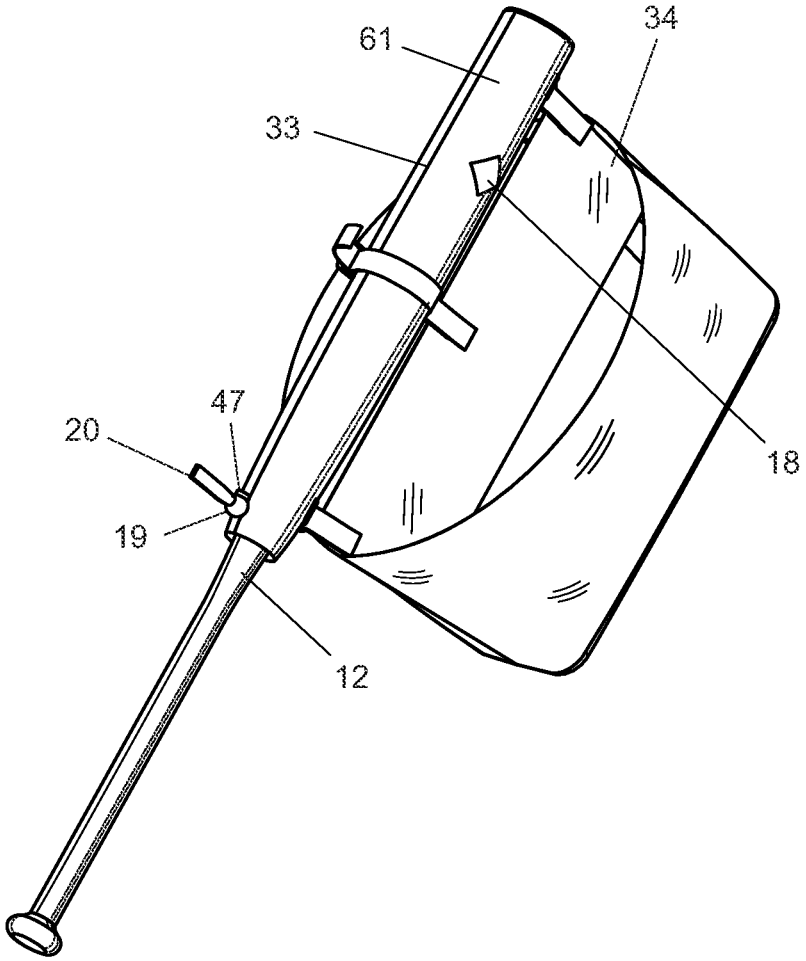
FIG. 4 is a perspective rear view of the sports swinging exercise device 50 over elongated sports equipment such as a bat.
Figure 8:
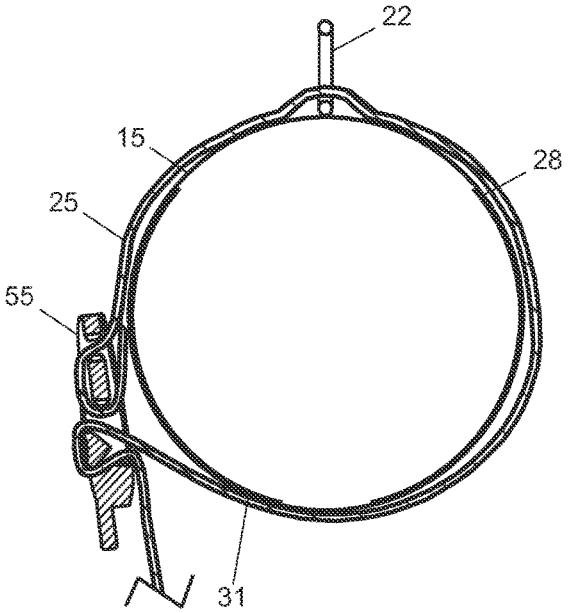
FIG. 8 is a section view of the strap 25, strap buckle 55, d-ring 22, sleeve 15 and non-slip material 28, 31.
Figure 9:
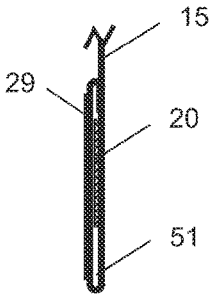
FIG. 9 is a detailed view of the sleeve cord channel 51, cord 20 and non-slip material 29.

(3) Secure the sleeve 15 onto the bat 10 by sliding cord lock device 19 pushing down the cord lock button 47 and down the cord 20 towards the bat neck 12 until it cannot go any further and release the cord lock device button 56 (as shown in FIG. 4, FIG. 8 and FIG. 9).

Figure 2:
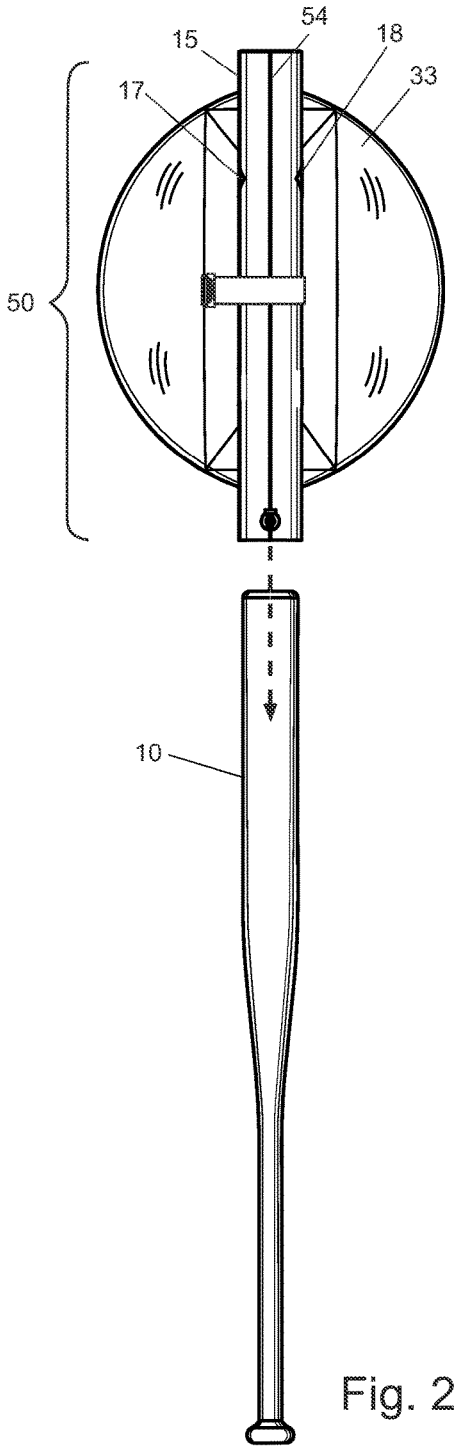
FIG. 2 is a front view of said sports swinging exercise device illustrated as fully inflated before placement on elongated sports equipment such as a bat.

(4) Orient the alignment marker 17/18 before the swing motion to orient the swing drag resistance device 50 in the most effective position (as shown in FIG. 2, FIG. 4 and FIG. 8).

Figure 10:
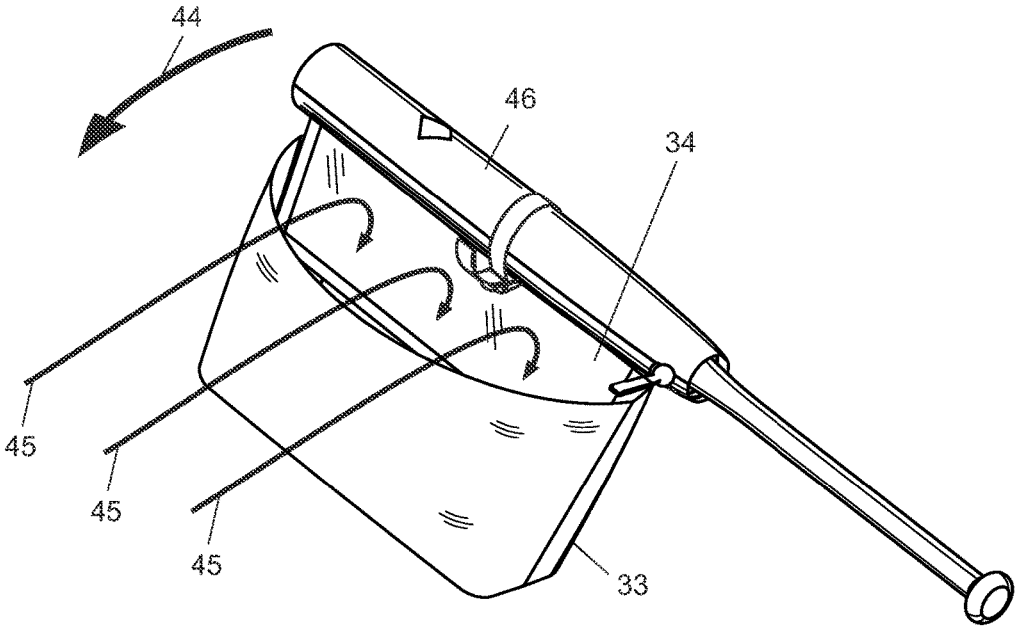
FIG. 10 is a perspective left front view of air resistance device 33 showing air 45 being direction into the said air resistance device 33 by the vane 34 immediately after the start of a swing.

(5) Set the elongated sports equipment at the start position and start the swinging motion (as shown in FIG. 10).

Figure 11:
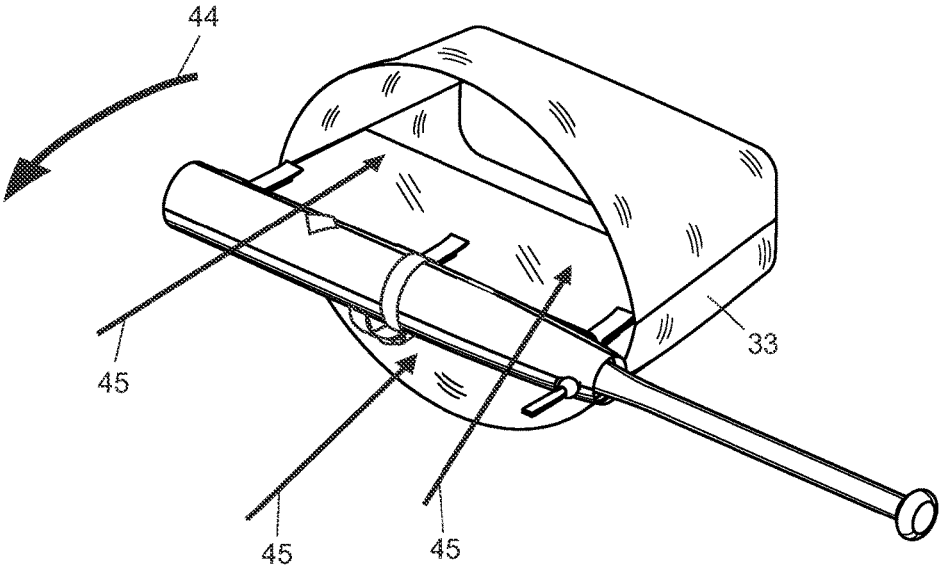
FIG. 11 is a perspective left front view of the air resistance device 33 during a swing motion showing air 45 inflating the air resistance device 33.

(6) Immediately after the start of the swing, air is directed into the air resistance device (as shown in FIG. 11) by the vane 34.

(7) As the swing motion is executed, air inflates the air resistance device (as shown in FIG. 10 and FIG. 11), creating air resistance until the swinging motion is completed.

(8) To begin again, the athlete re-orients with the alignment markers 17/18 and proceeds to starting position of the swing to begin the swinging motion with air resistance (as shown in FIG. 10).

Figure 18:
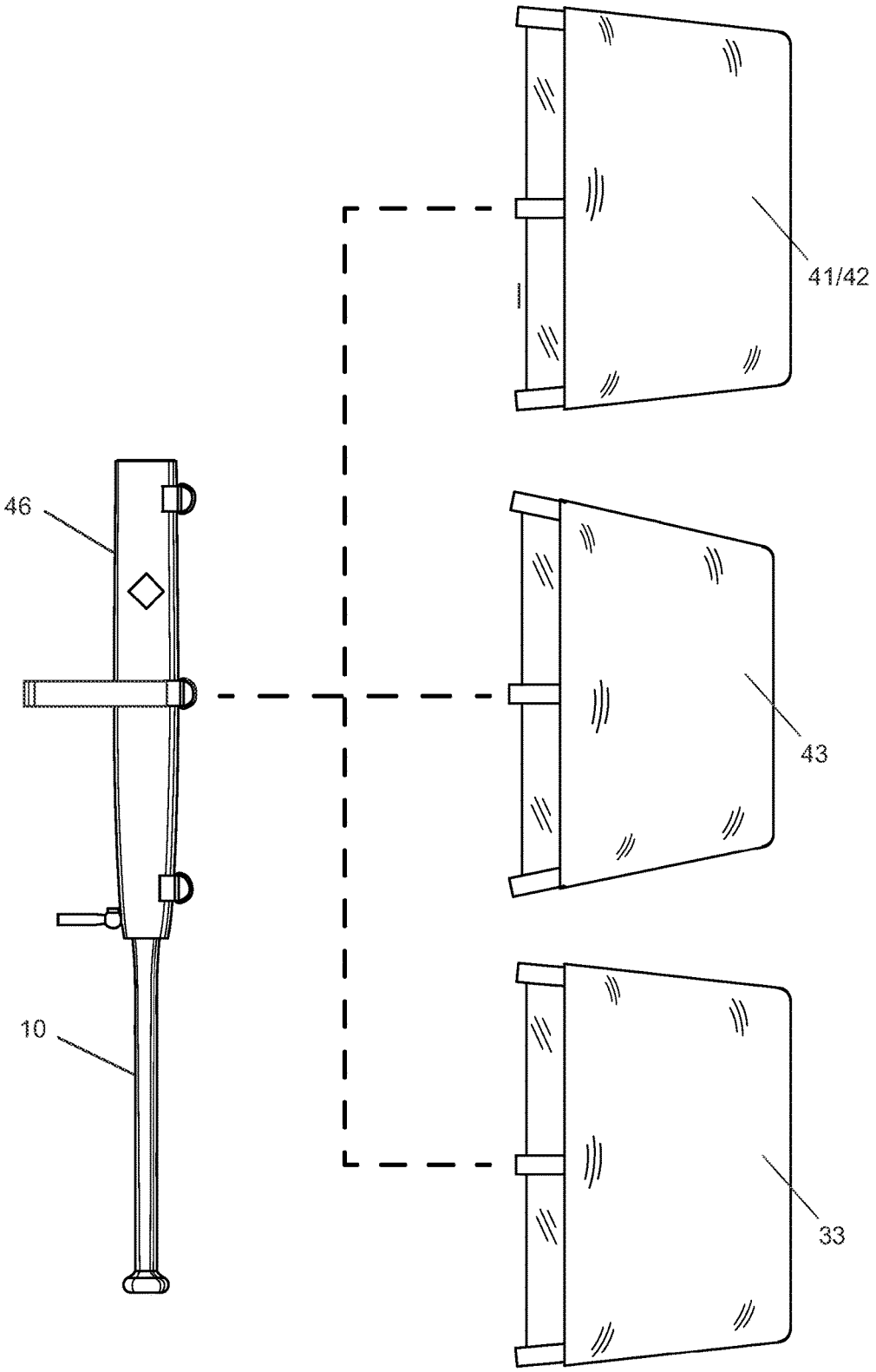
FIG. 18 is a drawing shows right views of different air resistance device 33, 41, 42 and 43 that can be attached to sleeve 46.

(9) If a change of air resistance is required the air resistance device can be de-attached (FIG. 18) and another air resistance device 33/43 of a different resistance or an air resistance device with variable openings 41/42 can be attached to take its place with the sleeve 51 on the bat 11 or with the sleeve 15 off the elongates sports equipment (as shown in FIG. 10, FIG. 11, and FIG. 18).

Having discussed the procedure of use of the device of the present invention, the included figures will now be detailed more thoroughly.

FIG. 1 depicts a perspective right-side view of the preferred embodiment of the present invention with air resistance device 33 with vane 34 attached to the open sleeve 15 being placed over elongated sport equipment 10. The air resistance device 33 is preferably shaped or sewn such that it has a triangular fold within the air resistance device 33 in order to facilitate the opening of the vane 34 during a swing of the elongated sport equipment. The example of elongated sport equipment is a bat 10. The bat 10 has a barrel 11, a neck 12, a handle 13 and a knob 14. The sleeve 15 is shown in the open position with the alignment marker 18 oriented for a right-handed user. The cord lock 19 is located on the cord 20 and away from the sleeve 15 so the cord 20 has enough slack to permit the barrel 11 of the bat 10 to slip inside the open end of the sleeve 15. A plurality of non-slip material 29 is located behind the sleeve cord channel 51.

FIG. 2 exhibits a front view of the sports swinging exercise device 50 of the present invention being placed over the elongated swinging sport equipment 10. From this view, both alignment markers 17 and alignment marker 18 can be seen on the sleeve 15. The air resistance device 33 is viewed looking down into it as it would appear fully inflated in FIG. 2.

Figure 3:
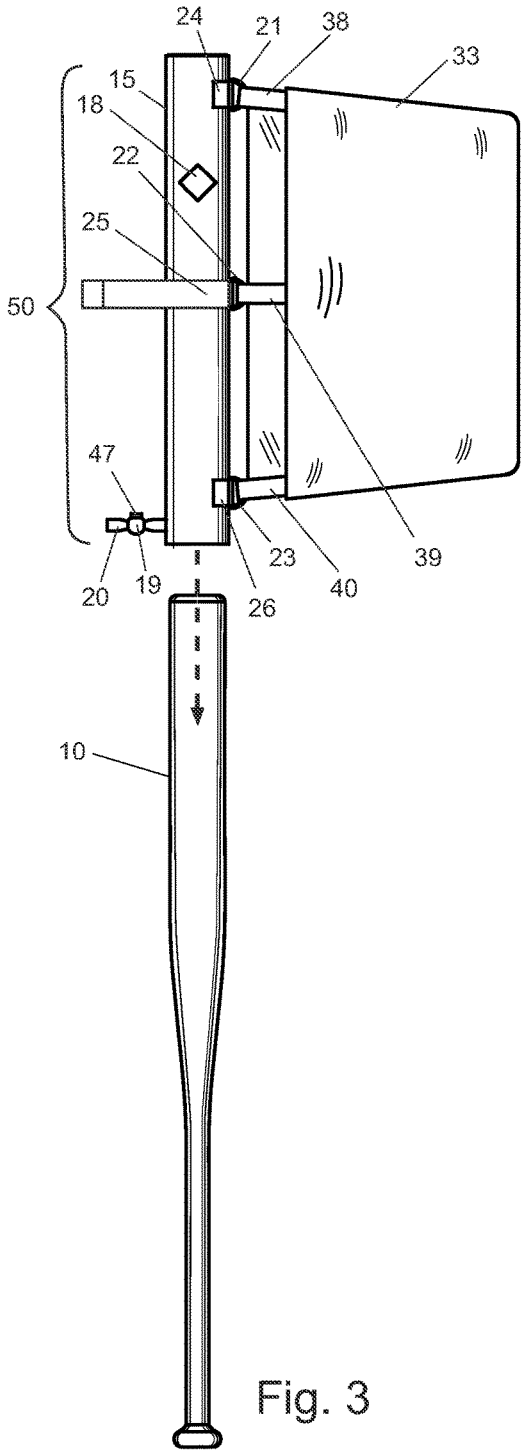
FIG. 3 is a right view of said sports swinging exercise device 50 before placement on elongated sports equipment such as a bat.

FIG. 3 shows a right view of the sports swinging exercise device 50 being placed over elongated sport equipment 10. The sports swinging exercise device 50 shows the air resistance device 33 (shown inflated for r in all views) and vane 34 attached to the sleeve 15 with plurality hook straps looping around the plurality of d-ring locations 21, 22, and 23 on the sleeve 15. The hook straps fasten to plurality loop pads 35, 36, and 37 located on the opposite side of vane 34. The plurality d-rings 21, 22 and 23 are fastened to the sleeve body 15 by plurality straps 24, 25 and 26. It shows the cord 20, cord lock 19/10 cord lock button 47. Cord knot at the end of cord 20 not shown for simplicity. Cord locking can be accomplished by spring loaded button or friction. From this view the alignment marker 18 can be seen.

FIG. 4 is a perspective rear view of the sports swinging exercise device 50 with air resistance device assemble 50 over the bat barrel 11 with an open sleeve 15.

Figure 5:
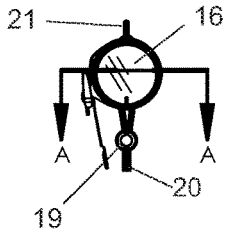
FIG. 5 is a top view of the top 16 of the sleeve 15.

FIG. 5 displays a straight-forward top view of the sleeve top 16 with a section line.

FIG. 6 is a front view of the sleeve 15 showing the seam of the sleeve 54 and where the cord 20 and cord lock 19 are approximately located.

Figure 7:
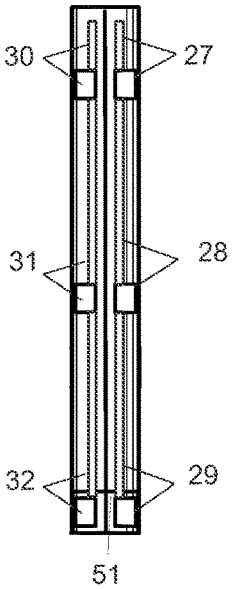
FIG. 7 is a section view of the sleeve 15.

FIG. 7 is a sectional view shows the plurality non-slip material 27, 28, 29, 30, 31 and 32 attached to the inside of the sleeve 15 to prevent the sleeve from slipping off the bat neck 12 and off the barrel 11. Plurality non-slip material 29 and 32 is located behind the sleeve cord channel 51.

FIG. 8 is a section view of the strap 25, strap buckle 55, d-ring 22, sleeve 15 and non-slip material 28, 31 showing the strap 25 sewn to said sleeve 15 to capture said d-ring 22 between them. When the strap 25 is tightened, the strap forces the non-slip material 28 of the present invention to be pressed against the elongated sport equipment, causing it to remain in position securely on the elongated sport equipment.

FIG. 9 exhibits a detailed view of the sleeve cord channel 51, cord 20 and non-slip material 29 showing how the cord 20 is inside of the cord channel 51 and the non-slip material is on the inner outside wall of the said cord channel 51.

FIG. 10 details a perspective left front view showing the sports swinging exercise 50 at the beginning of a swing 44. Air 45 going into vane 34 is directed down into the air resistance device 33 is starting to inflate it with air.

FIG. 11 is a perspective left view showing the swing drag parachute 50 secured on a bat during a full swing 44 with air 45 fully inflating the air resistance device 33.

Figure 12:
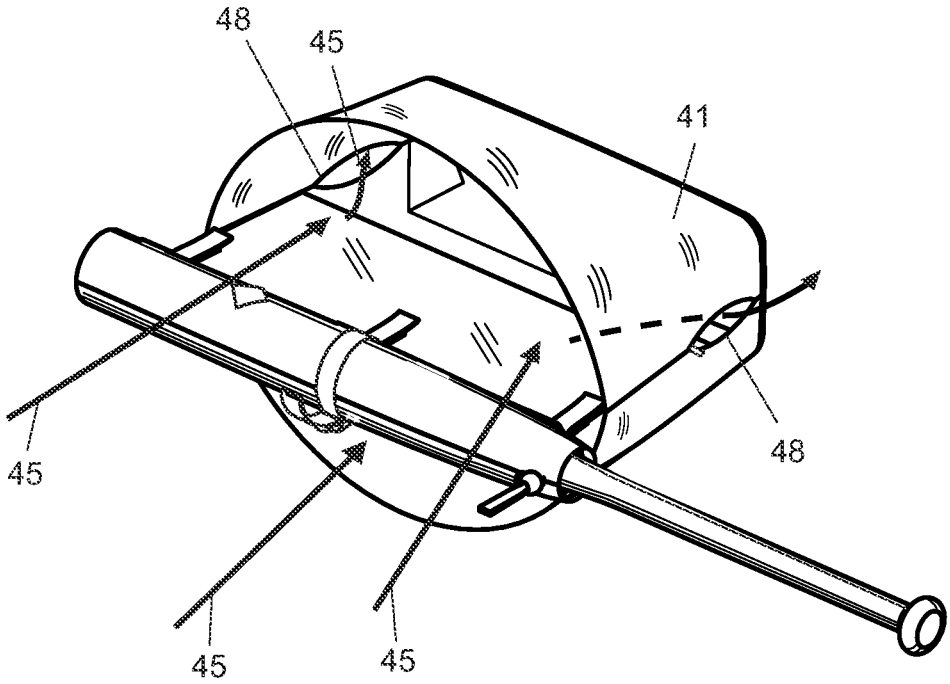
FIG. 12 is a perspective front view of air resistance device with side variable openings 48.

FIG. 12 is a perspective front view of the sports swinging exercise device 50 secured on a bat 10 during a full swing with air 45 fully inflating the air resistance device 41 with a variable side openings feature 48 letting some air escape out of the air resistance during the swing. The variable side openings 48 can be controlled by a zipper. Instead of a zipper, the openings size could control by hook and loop, snaps, flaps or other means.

Figure 13:
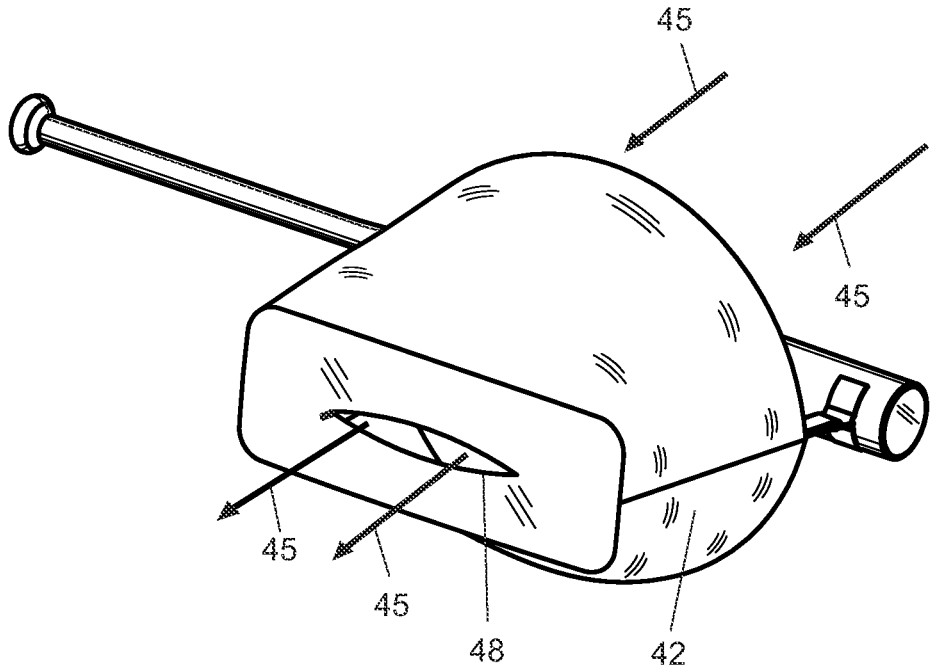
FIG. 13 is a perspective rear view the present invention with a bottom variable opening 42.

FIG. 13 is a perspective rear view of the sports swinging exercise device 50 secured on a bat 10 during a full swing with air 45 fully inflating the air resistance device 42 with a variable bottom opening feature 48 letting some air escape out of the air resistance during the swing. Not shown is an air resistance device with side and bottom variable openings. The variable bottom opening(s) 48 could be controlled by a zipper. Instead of a zipper, the opening size could be controlled by hook and loop, snaps, or flaps or other similar means.

Figure 14:
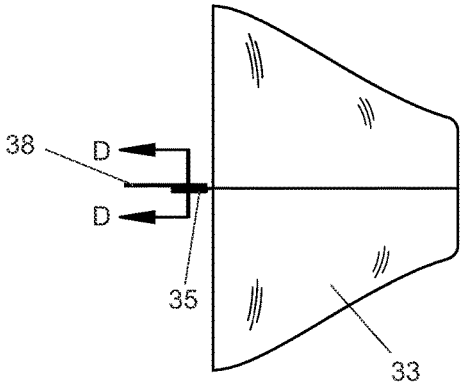
FIG. 14 is a top orthographic view of medium air resistance device 33.

FIG. 14 displays a top view of the air resistance device of the present invention with a section line through the plurality hook 35, 36 and 37, plurality loop strap 38, 39 and 40 locations on the vane 34. The air resistance device 33 is shown inflated, as it would when swung by an athlete during use of the present invention.

Figure 15:
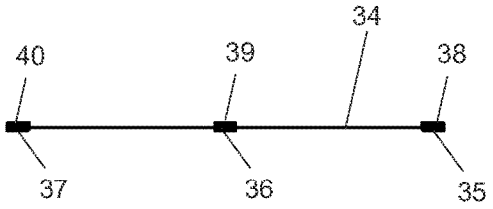
FIG. 15 is a section view of FIG. 14 vane 34.

FIG. 15 shows a section view of the present invention, showing the locations of the plurality hook pad 35, 36 and 37 and the plurality loop straps 38, 39 and 40 disposed on the right side of the vane 34.

Figure 16:
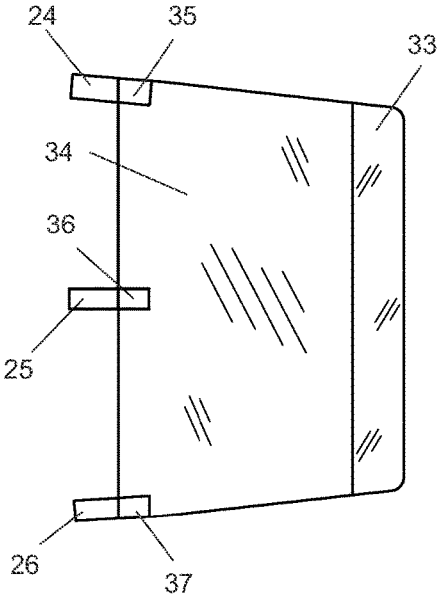
FIG. 16 displays a section of medium air resistance device 33.

FIG. 16 displays a view of the air resistance device 33 of the present invention, showing the plurality of hook pad locations 35, 36 and 37 on the front side of the vane 34. The plurality loop straps 24, 25 and 26 are shown in the open position and on the right side of the vane 34.

Figure 17:
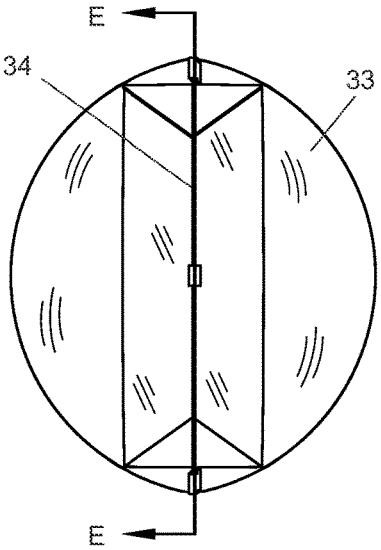
FIG. 17 is a front orthographic view of medium air resistance device 33.

FIG. 17 is a front view of an air resistance device 33. The air resistance device 33 is shown inflated.

FIG. 18 depicts that the sleeve 46 on elongated sports equipment can accept plurality of different air resistance devices 33, 41, 42 and 43 that can be attached to the plurality d-rings 21, 22, and 23. The plurality d-ring attachment feature can be other shapes such as a circle or rectangle, and can be made from metal, plastic, strap material, cord or fabric.

FIG. 19 is an orthographic view of air resistance device 43 front, right side, and top views, to show the preferred size and shape of the present invention.

FIG. 20 displays an orthographic view of air resistance device 33 front, right side, and top views, to show the preferred size and shape of the present invention.

Figure 21:
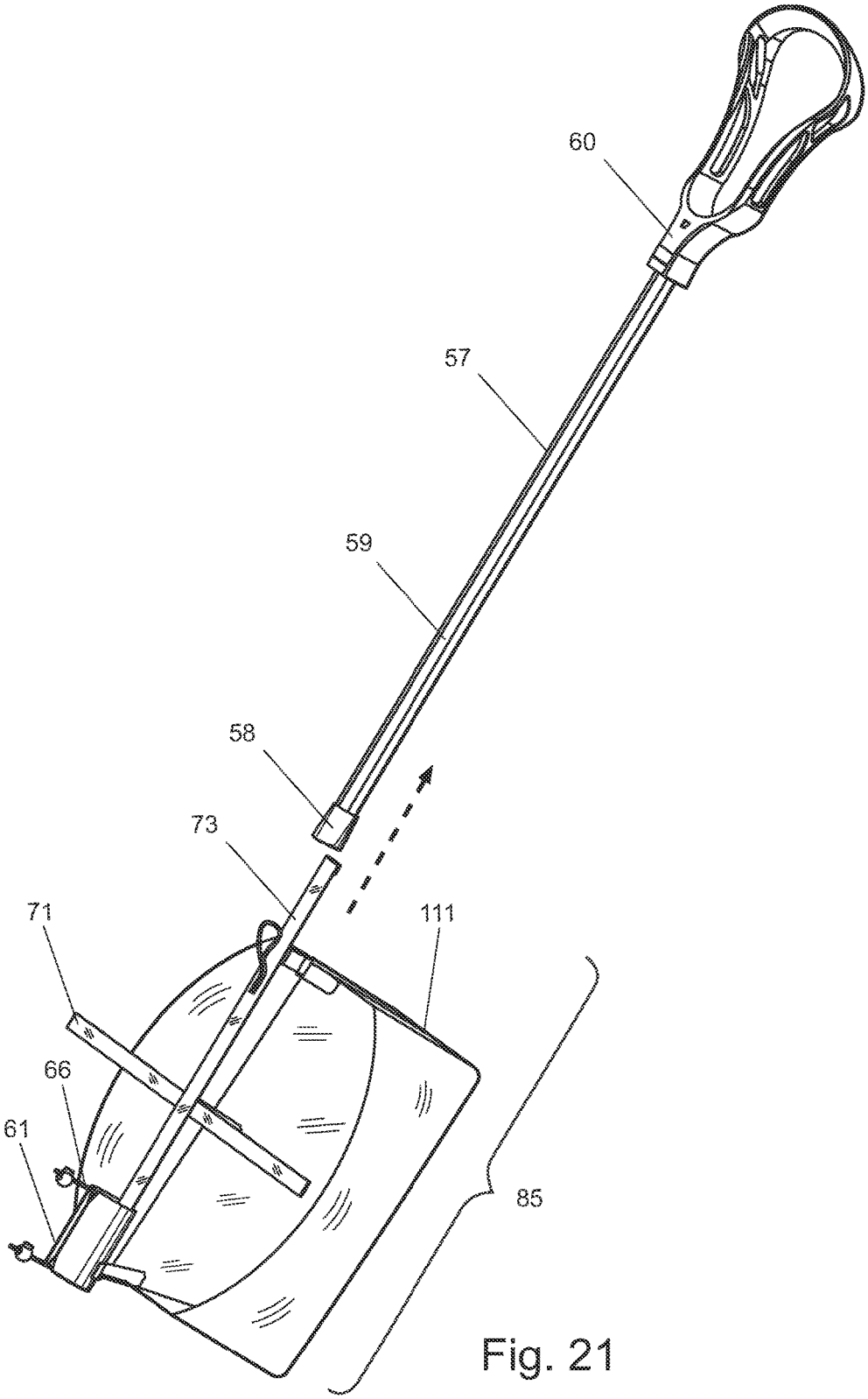
FIG. 21 is a perspective right side view of the sports swinging exercise device with cord 64 nearest the stick knob 58 placement of invention on elongated sports equipment such as a lacrosse stick 57.

FIG. 21 is a perspective right side view of the sports swinging exercise device with cord 64 nearest the stick knob 58 placement of invention on elongated sports equipment such as a lacrosse stick 57. The cord is the visual indicator of contrasting color to guide the athlete to place this end of the sleeve 61 over the stick knob 58 first, and visually indicates the end which should be placed closest to the lacrosse head 60. The straps 71 and 73 are shown flat and the air resistance device 111 is shown inflated for clarification.

Figure 22:
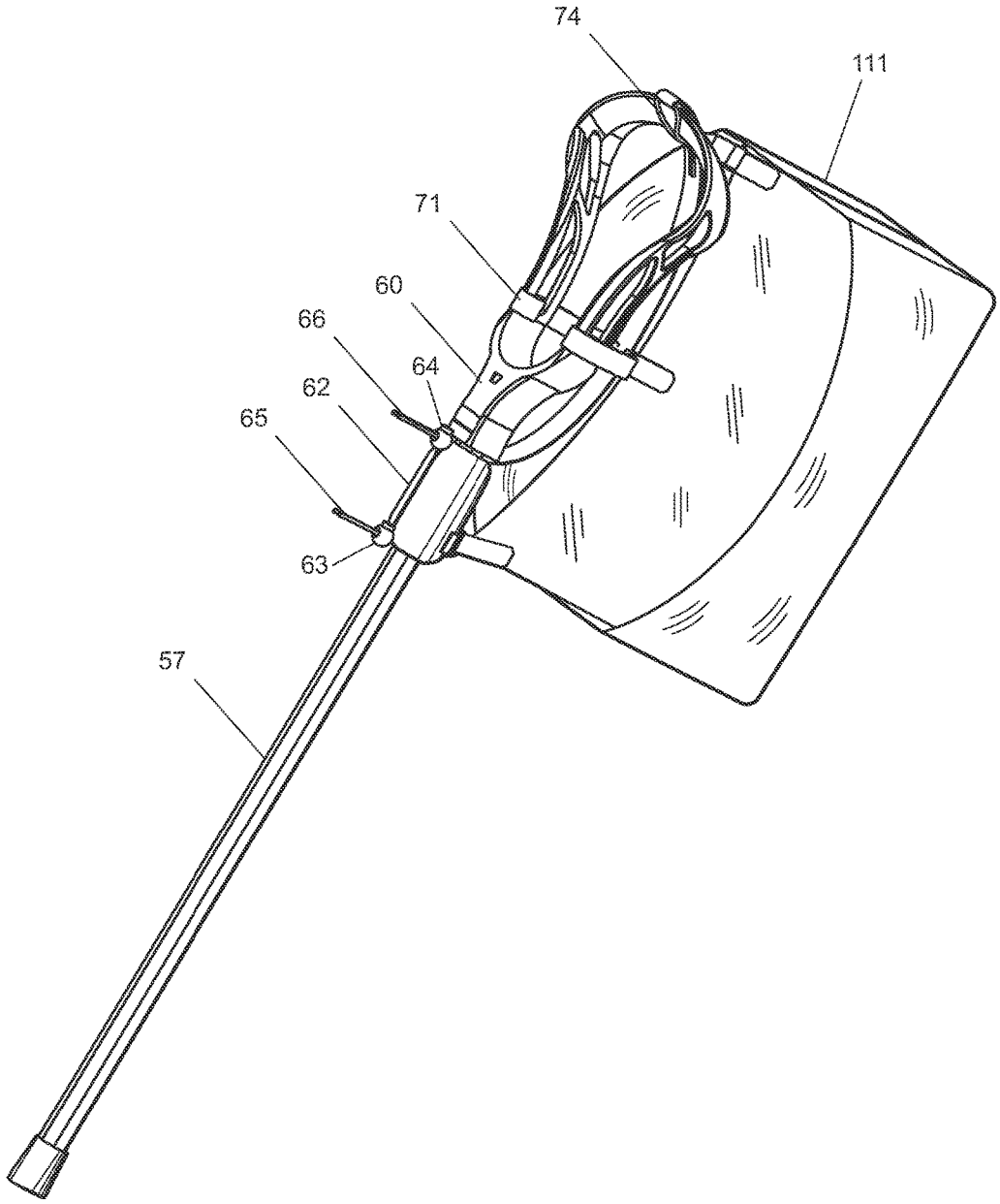
FIG. 22 is a perspective rear view of the sports swinging exercise device 85 over elongated sports equipment such as a lacrosse stick 57.

FIG. 22 is a perspective rear view of the sports swinging exercise device 85 over elongated sports equipment such as lacrosse stick 57 shows cord—indicator 66 nearest the lacrosse head 60 with plurality straps 71 and 73 and plurality cords 71 used to secure sports swinging device 85 to the lacrosse stick 57. Strap 71 is fed through a series of side openings of lacrosse head 60 and is fastened to itself with a plurality of hook pads 82, 83 and loop pads 79, 80. Cord 74 is preferably a loop which is configured to go through one of the eyelets in the lacrosse head net. The strap 73 is threaded into the cord loop 74. Next, the strap 73 captures the cord 74 and fastens the strap 73 to itself with a plurality of hook pads 84 and a plurality of loop pads 81. The plurality of hook pads 84 and plurality of loop pads 81 can be other conventional fastening mechanisms such as snaps, bolt snaps and twist lock fasteners.

Figure 23:
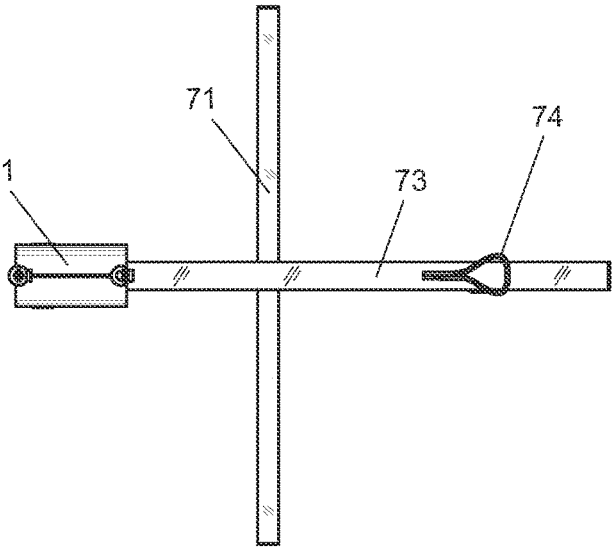
FIG. 23 is a top view of the sports swinging exercise device 71 without air resistance device 85 for simplicity.

FIG. 23 is a top view of the sports swinging exercise device 85 without the air resistance device 111, and depicts the sleeve 61 with a plurality of straps 71 and 73 disposed in the flat position for clarity, as well as the cord 74.

Figure 24:
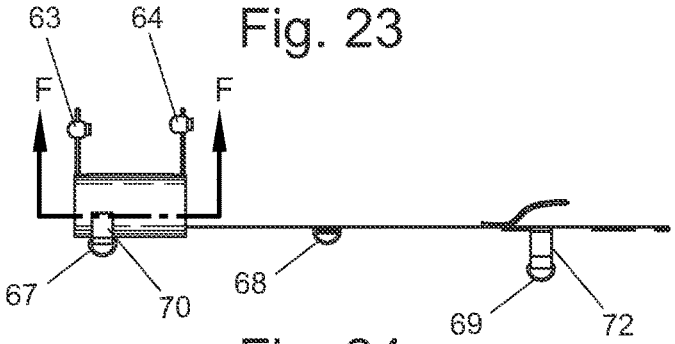
FIG. 24 is a right view of the sports swinging exercise device 71 without air resistance device 85 for simplicity.

FIG. 24 is a right view of the sports swinging exercise device 85 without air resistance device 111 shows plurality of d-rings 67, 68 and 69 and straps 70 and 72. Cord locks 63 and 64 are located away from sleeve 61 when in the open position.

Figure 25:
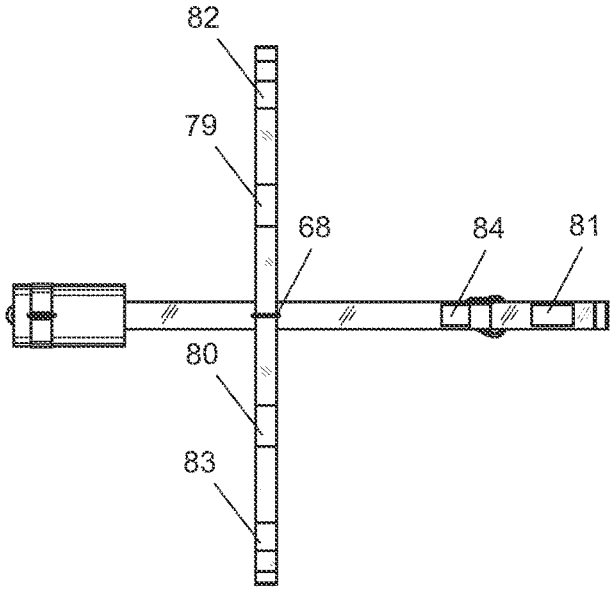
FIG. 25 is a bottom view the sports swinging exercise device 71 without air resistance device 85 for simplicity.

FIG. 25 is a bottom view of the sports swinging exercise device 85 without air resistance device 111 for simplicity shows plurality hook pads 82, 83 and 84 and loop pads 79, 80 and 81. As shown, d-ring 68 is captured by the straps 71, 73.

Figure 26:
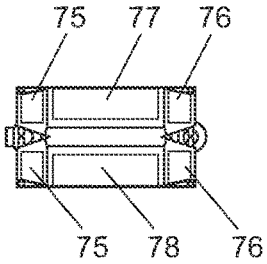
FIG. 26 is a partial section view of FIG. 24

FIG. 26 is a partial section view of FIG. 24 shows plurality non-slip material 75, 76, 77 and 78 attached to inside of sleeve 61 to prevent the said sleeve from slipping.

Figure 27:
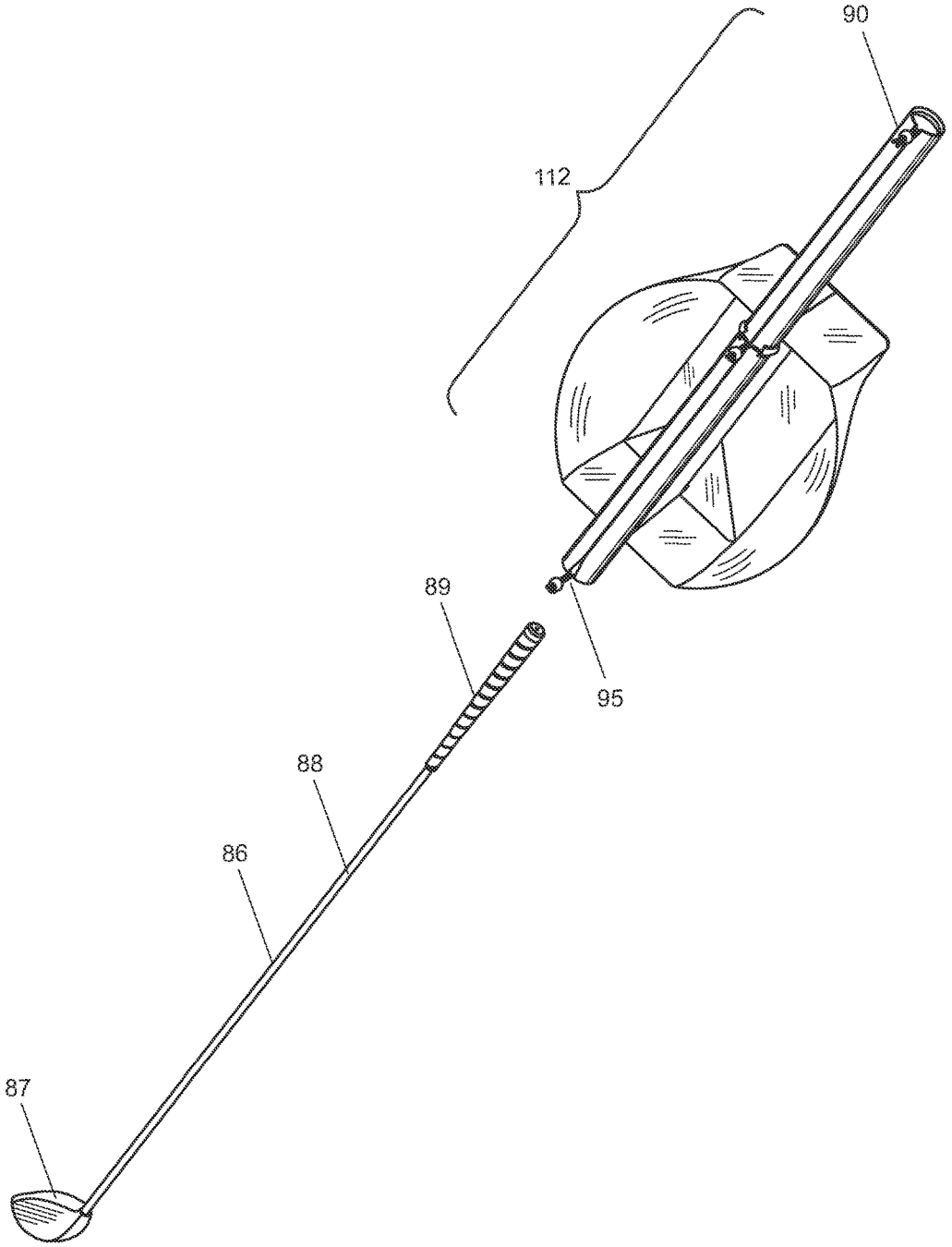
FIG. 27 is a perspective rear view of the sports swinging exercise device 112 before placement of invention on elongated sports equipment such as a golf club 86.

FIG. 27 is a perspective rear view of the sports swinging exercise device 112 before placement of invention on elongated sports equipment such as a golf club 86. The sleeve 90 is in the open position in FIG. 27. The cord 95 is the visual indicator of contrasting color to guide the athlete to place this end of the sleeve 90 over the golf grip 89 first and then over the golf shaft 88 and should be the close to the golf head 87.

Figure 28:
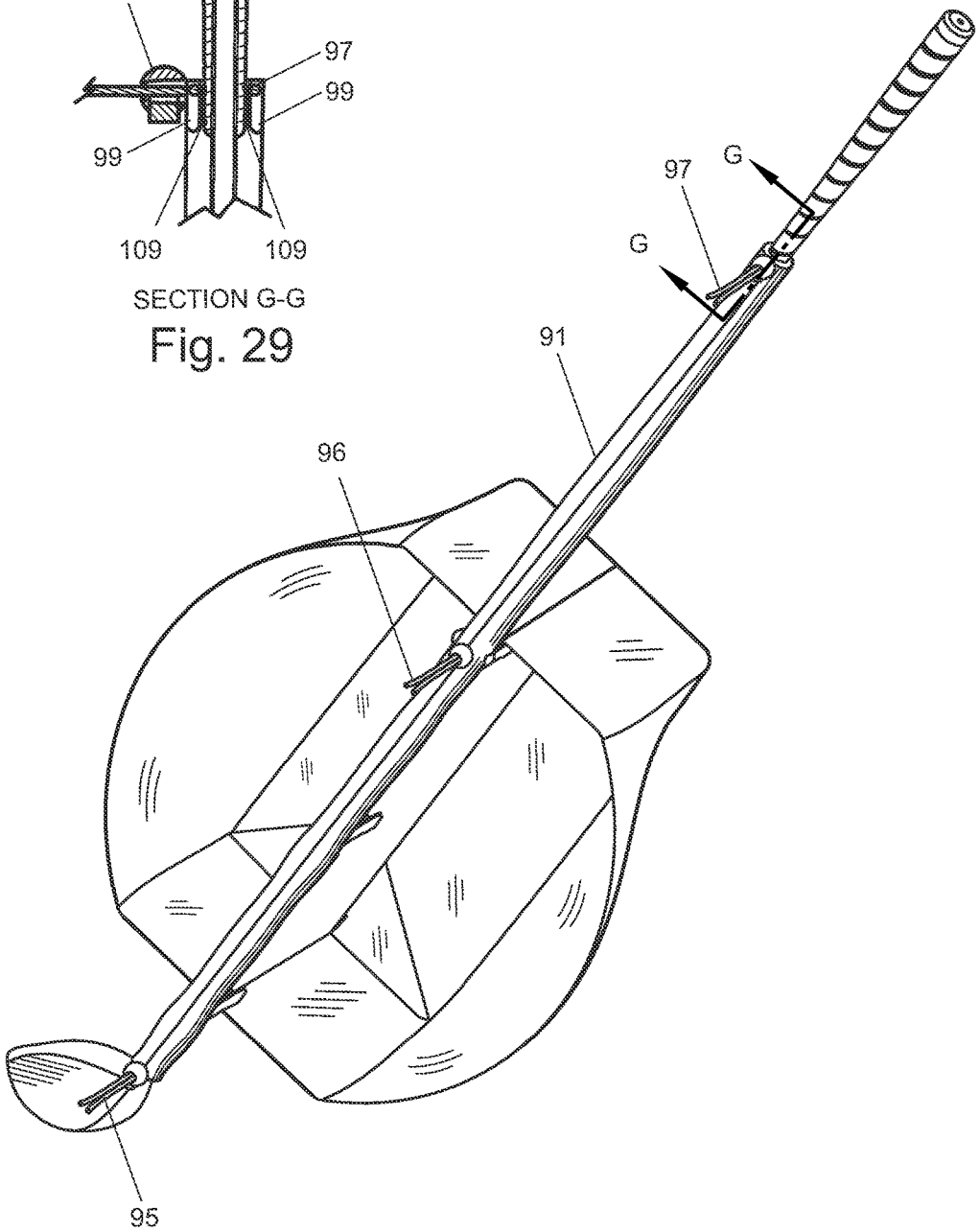
FIG. 28 is a perspective rear view of the sports swinging exercise device 112 over elongated sports equipment such as a golf club with partial section view.

FIG. 28 is a perspective rear view of the sports swinging exercise device 112 with the sleeve 91 closed over elongated sports equipment such as a golf club with a partial section view. Cord 95 is the visual indicator of contrasting color is located near the golf club head 87. Cord knot at the end of cord 95, 96 and 96 not shown for simplicity.

Figure 29:
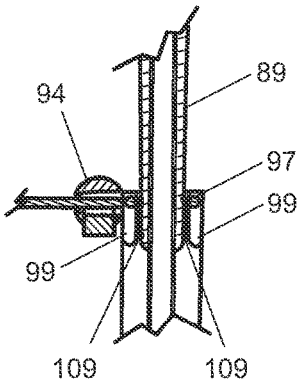
FIG. 29 is a partial section view of FIG. 28.

FIG. 29 is partial section view from FIG. 28 which shows the plurality of non-slip material 109 next to a golf grip 89 on the inside of cord channel 99 and a plurality of cord 97 tightened in place by a plurality of cord locks 94 to prevent the sports swing exercise device 112 from slipping down the golf club 86 during use, or changing position.

Figure 30:
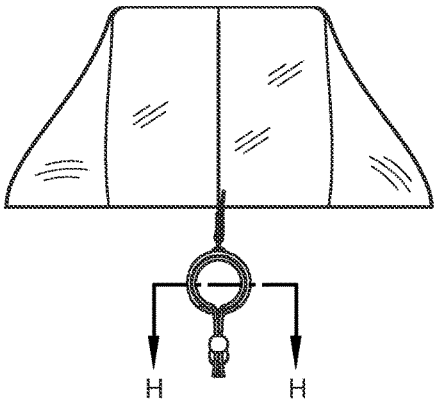
FIG. 30 is a top view of sports swinging exercise device 112 with section line across sleeve 90.

FIG. 30 exhibits a top view of the sports swinging exercise device 112 with a section line across the sleeve 90. The air resistance device 111 is shown as inflated for ease of display.

Figure 31:
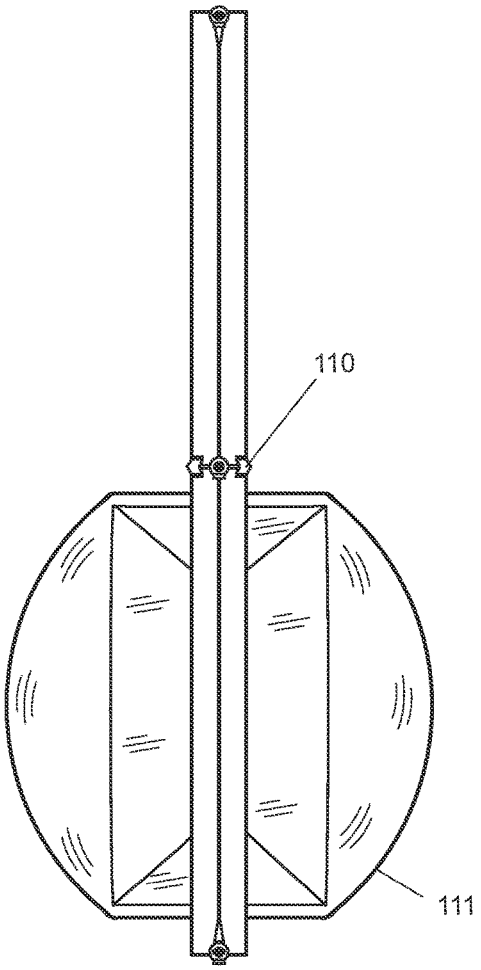
FIG. 31 is a front view of sports swinging exercise device 112.

FIG. 31 shows a front view of the sports swinging exercise device 112 of the present invention. Within FIG. 31, the plurality cord channel 100 is displayed as attached to the outside of the sleeve 90. The present invention is shown as inflated in FIG. 31 for simplicity.

Figure 32:
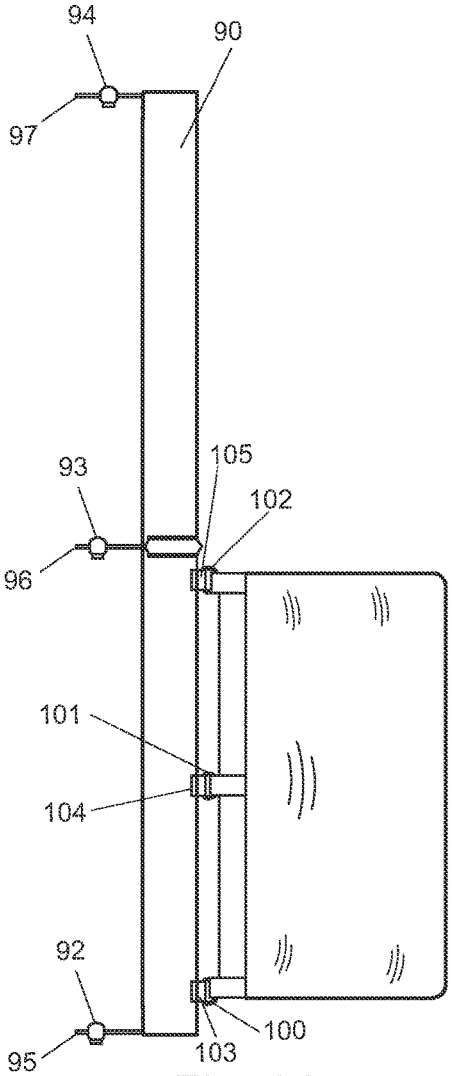
FIG. 32 is right side view of sports swinging exercise device 112.

FIG. 32 displays a right side view of the preferred embodiment of the present invention. The sleeve 90 is shown in the open position. The cord lock 92, 93 and 94 is located on the cord 95, 96 and 97, away from the sleeve 90, so that the cord 95, 96 and 97 has enough slack to permit the sleeve 90 to slip over the glove grip 89 of the golf club 86. Plurality of d-ring locations 100, 101 and 102 are attached to sleeve 90 with plurality of straps 103, 104 and 105. The plurality d-ring attachment feature can be formed in other shapes such as a circle or rectangle, and may be made from metal, plastic, strap material, cord, or fabric. The air resistance device 111 is shown inflated for ease of reference. In actuality, the present invention is generally only in the inflated position during the swing of the user. It should be understood that the d-ring attachment feature, as well as the straps 70, 72 of the present invention enable the sleeve 15 of the air resistance device 111 to be interchangeable both with other sleeves 15 of the present invention that vary in size, in order to vary the degree of resistance provided to the user during the swing.

Figure 33:
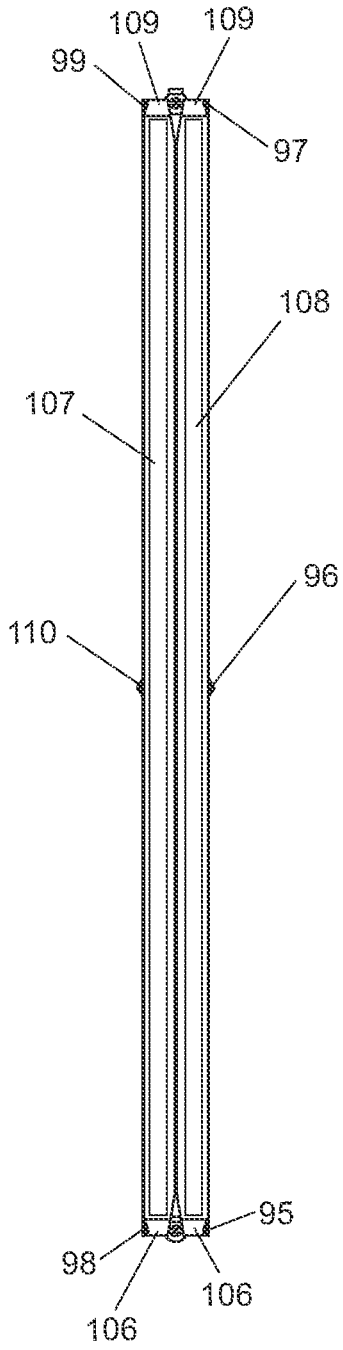
FIG. 33 is section view of FIG. 30.

FIG. 33 is a section view of FIG. 30 shows plurality non-slip material 106. 107, 108 and 109 attached to inside of sleeve 90 to prevent the said sleeve from slipping. The section view shows plurality Cord channel 98, 99 and 110 with plurality of cords 95, 96 and 97 locations.

Figure 34:
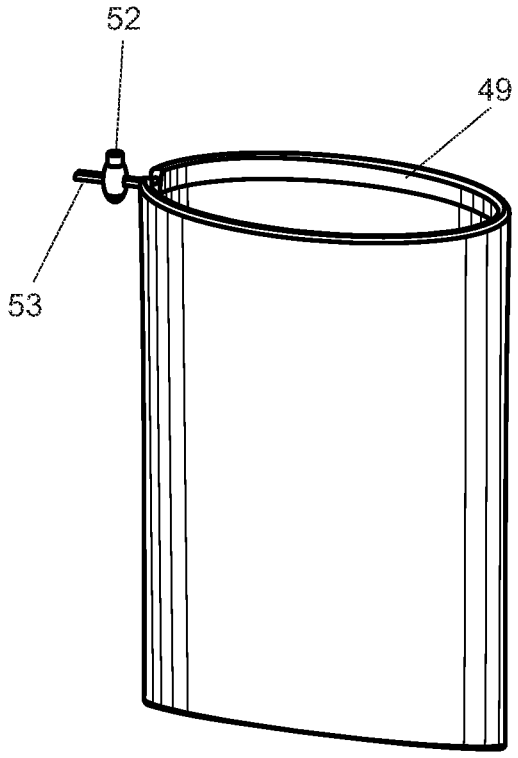
FIG. 34 is a right perspective view of storage bag 49.

FIG. 34 is a right perspective view of the storage bag 49 with a cord 52 and cord lock 53. The storage bag 49 is large enough to store the sports swinging exercise 50 and optional plurality air resistance devices 33, 41, 42, and 43.

Additionally, there are preferably two alignment marker shapes 17,18 that are preferably of contrasting color located on the sleeve 15. The color of the alignment marker shapes 17,18 are preferably colored to contrast with the color of the sleeve 15. The first alignment marker shape 17 is on the left for left handed athletes 17, and the second alignment marker shape 18 is on the right for right handed athletes. The alignment marker shapes 17, 18 may be diamond, circle, square or other shapes. Both alignment marker shapes 17, 18 help the athlete to orient the invention in the best possible position of operation.

The sports swinging exercise device 50 of the present invention is preferably constructed using rip-resistant nylon, however other materials may also be suitable. Elements of the present invention are preferably sewn together but other methods, such as a unitary piece of fabric, may also be used. Other portions of the present invention may be pre-manufactured and conventional, such as the hook and loop fasteners, cord, and d-ring loops.

Having illustrated the device and method of use of the present invention, it should be understood that various adjustments and versions might be implemented without venturing away from the essence of the present invention. Further, it should be understood that the present invention is not solely limited to the invention as described in the embodiments above, but further comprises any and all embodiments within the scope of this application.

The foregoing descriptions of specific embodiments of the present invention have been presented for purposes of illustration and description. They are not intended to be exhaustive or to limit the present invention to the precise forms disclosed, and obviously many modifications and variations are possible in light of the above teaching. The exemplary embodiment was chosen and described in order to best explain the principles of the present invention and its practical application, to thereby enable others skilled in the art to best utilize the present invention and various embodiments with various modifications as are suited to the particular use contemplated.

I claim:

1. A resistance device for elongated sport equipment comprising:

a sleeve, said sleeve configured to completely surround at least one portion of the elongated sport equipment;

a cord channel disposed interior of said sleeve;

a cord, disposed within said cord channel;

a slip-resistant material disposed interior of said cord channel;

a vane, in communication with said sleeve, said vane being planar and disposed within an air resistance device, said vane and said air resistance device depending from said sleeve;

wherein said vane is configured to inflate when the elongated sport equipment is in motion;

wherein said sleeve rotates about the elongated sport equipment according to movement of the elongated sport equipment through air;

a side opening of said sleeve, said side opening positioned at a side portion of said sleeve behind said vane; and a strap.

* * * * *